US005603268A

United States Patent [19]

Kinoshita et al.

[11] Patent Number: 5,603,268

[45] Date of Patent: Feb. 18, 1997

[54] COAL PULVERIZER ASSOCIATED WITH A ROTARY CLASSIFIER AND METHOD FOR OPERATING THE SAME

[75] Inventors: Masaaki Kinoshita; Yutaka Iida, both of Nagasaki, Japan

[73] Assignee: Mitsubishi Jukogyo Kabushiki Kaisha, Toyko, Japan

[21] Appl. No.: 280,502

[22] Filed: Jul. 26, 1994

[30] Foreign Application Priority Data

Jul. 26, 1993 [JP] Japan ..... 5-183886

[51] Int. Cl.[6] ..... F23B 7/00

[52] U.S. Cl. ..... 110/342; 110/186; 110/101 C; 110/220

[58] Field of Search ..... 110/101 C, 101 CF, 110/185, 186, 220, 191, 341; 241/33, 34, 35, 36

[56] References Cited

U.S. PATENT DOCUMENTS

| | | | |
|---|---|---|---|
| 4,478,371 | 10/1984 | Williams . | |
| 4,804,148 | 2/1989 | Etheridge . | |
| 5,003,891 | 4/1991 | Kaneko et al. | 110/341 |
| 5,158,024 | 10/1992 | Tanaka et al. | 110/185 |

FOREIGN PATENT DOCUMENTS

| | | | |
|---|---|---|---|
| 5-149526 | 6/1993 | Japan | 110/101 C |

OTHER PUBLICATIONS

Patent Abstracts of Japan, vol. 17, No. 93 (C–1029) Feb. 24, 1993.

Patent Abstracts of Japan, vol. 16, No. 425 (C–0982) Sep. 7, 1992.

*Primary Examiner*—Denise L. Gromada
*Assistant Examiner*—Susanne C. Tinker
*Attorney, Agent, or Firm*—Wenderoth, Lind & Ponack

[57] ABSTRACT

A control system of coal pulverizer associated with a rotary classifier, applicable to a pulverized coal burning boiler or the like, includes a function generating section, a computing section, and a rotational speed controlling section. The function generating section receives a signal representing a coal feed rate and outputs signals representing a preset proper range of a current to be fed to the motor of the coal pulverizer for such coal feed rate. The computing section is responsive to a signal representing the current motor current and the signals produced by the function generating section to output a command signal which will maintain the speed of the rotary classifier when the motor current represented by the motor current signal is within the proper range, and to output a command signal which will decrease or increase the speed of the rotary classifier, respectively, in the case where the same motor current has increased or decreased beyond the proper range. The rotational speed controller receives the command signal and regulates the speed of the rotary classifier on the basis of the command signal.

2 Claims, 6 Drawing Sheets

COAL PULVERIZER ASSOCIATED WITH A ROTARY CLASSIFIER AND METHOD FOR OPERATING THE SAME

BACKGROUND OF THE INVENTION

1. Field of the Invention

The present invention relates to a coal pulverizer associated with a rotary classifier applicable to a fuel feed system of a pulverized coal burning boiler or the like.

2. Description of the Prior Art

In a heretofore known coal pulverizer associated with a rotary classifier applicable to a pulverized coal burning boiler, a method for controlling the rotary speed of the rotary classifier either set the speed to a constant value as indicated by a curve a in FIG. 5 or set the speed to a number of values as a function of a coal feed rate as indicated by the segments of curve b.

Under a constant coal feed rate, if the rotary speed of the rotary classifier is increased, the grains of pulverized coal at the outlet of the coal pulverizer become fine. Also, a load on the coal pulverizer increases and a motor current also increases. On the contrary, if the speed of the rotary classifier is decreased, the grains of the pulverized coal at the outlet of the coal pulverizer become coarse. Also, a load on the coal pulverizer and the motor current decrease.

In the event that a property (brand) of the coal fed to the coal pulverizer has changed, for instance, in the case where it has changed from high grindability (soft coal) to low grindability (hard coal), a motor current of the coal pulverizer increases for the same coal feed rate. In the case of very hard coal, sometimes the motor current exceeds a rated current, resulting in a motor trip. On the other hand, in the case where the coal is very soft, it is desirable to obtain an as high as possible degree of pulverization to achieve a high efficiency in the operation of the boiler. To this end, it is necessary to increase a motor current of the coal pulverizer.

In view of these considerations, a method shown in FIG. 6 has been proposed. In this method, the rotary speed of the rotary classifier is manually changed depending upon the brand of coal used.

However, since all of the coal is fed at once to a large hopper known as a "coal bunker", it is difficult to precisely know when the brand of coal fed to the pulverizer has changed. In addition, it is not rare for the property (especially grindability) of coal to vary greatly throughout even coal of the same brand. Therefore, even the method of FIG. 6 cannot properly establish the speed of the rotary classifier.

SUMMARY OF THE INVENTION

It is therefore one object of the present invention to provide an improved method and control system for operating a coal pulverizer associated with a rotary classifier, in which current of the motor of the pulverizer can be prevented from exceeding a rated value and thus tripping of the motor can be prevented, while a high efficiency of the operation of a boiler receiving coal from the classifier is maintained.

The method for operating a coal pulverizer associated with a rotary classifier, includes the steps of presetting a range of the motor current of the coal pulverizer as a function of the feed rate of coal to the pulverizer, and controlling the speed of the rotary classifier so that the motor current of the coal pulverizer will fall in the preset range for any coal feed rate.

For instance, in the event that the coal being fed to the pulverizer has changed to a hard species (brand) of coal, the motor current will rise and may exceed the preset range. However, in this case, the speed of the rotary classifier is controlled so as to decrease according to the invention. As the speed of the rotary classifier decreases, a load on the coal pulverizer decreases. Hence, an increase in the motor current of the coal pulverizer is stopped (or the motor current is decreased) according to the invention to remain within the preset range.

In this way, the motor can be reliably operated without tripping.

The coal system of the coal pulverizer comprises a function generator responsive to a coal feed rate signal inputted thereto for outputting signals representing a proper range of a motor current of the coal pulverizer; a computing unit responsive to a motor current signal of the coal pulverizer and the signals output from the function generator for outputting a command signal which will maintain the speed of the rotary classifier when the motor current of the coal pulverizer is within the proper range, and for outputting a command signal which will decrease or increase the speed of the rotary classifier when the motor current has increased or decreased, respectively, beyond the proper range; and a rotational speed controller responsive to the command signal of the computing unit for regulating the speed of the rotary classifier.

In the coal pulverizer having the above-featured structure, the motor current of the coal pulverizer will always be maintained within a proper range even if the species of coal should change. Accordingly, the coal pulverizer can be operated safely without the motor thereof tripping.

The above-mentioned and other objects, features and advantages of the present invention will become more apparent by referring to the following description of one preferred embodiment of the invention made in conjunction with the accompanying drawings.

DETAILED DESCRIPTION OF THE PREFERRED EMBODIMENTS

Now one preferred embodiment of the present invention will be described with reference to FIGS. 1 to 4 and 7–9.

Figure 1:
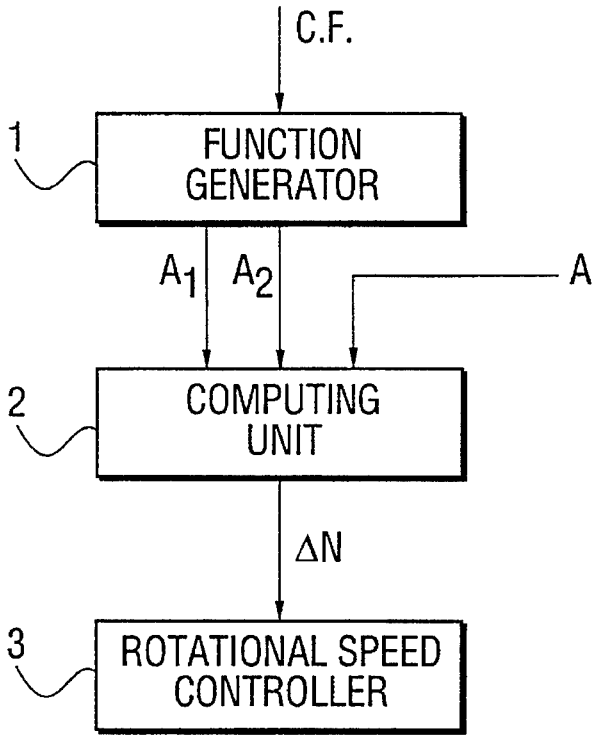
FIG. 1 is a block diagram of one preferred embodiment of the present invention.
Figure 2:
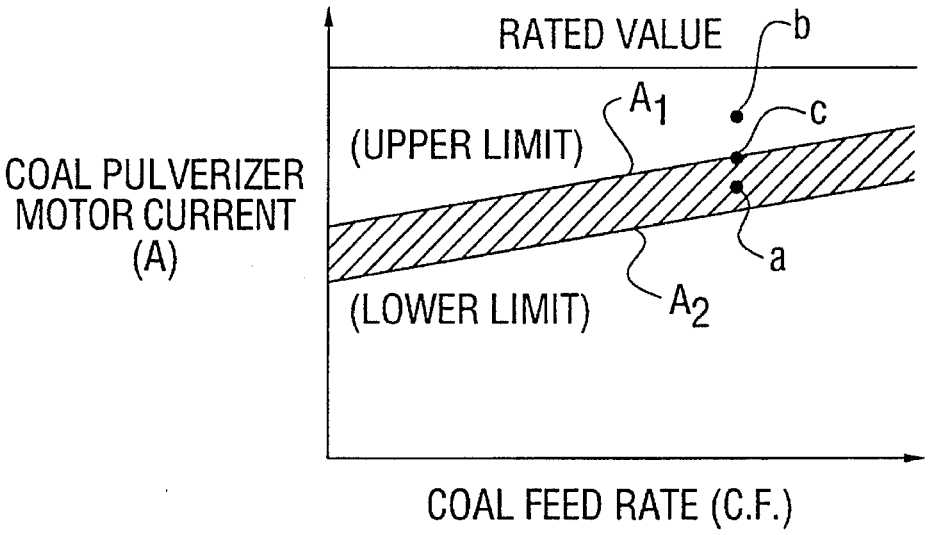
FIG. 2 is a graph of data produced by the computing unit of the same preferred embodiment.

In FIG. 1, a coal feed rate signal C.F. representative of a rate at which coal is fed to a coal pulverizer associated with a rotary classifier is inputted to a function generator 1, and the function generator 1 outputs signals $A_1$ (upper limit) and $A_2$ (lower limit) representing a preset proper range of a motor current of the coal pulverizer corresponding to a given coal feed rate as shown in FIG. 2. A computing unit 2 receives a signal A, representative of a motor current of the coal pulverizer, and the signals $A_1$ and $A_2$ issued from the function generator 1, compares these signals and outputs the following command signal:

(a) If the motor current indicated by the motor current signal A exists within the proper range delimited by the proper range signals $A_1$ and $A_2$, then a command signal $\Delta N=0$ is output to maintain the rotational speed of the rotary classifier.

(b) If the motor current indicated by the motor current signal A is greater than the upper limit delimited by the proper range signal $A_1$, then a command signal $\Delta N>0$ is output to lower the rotational speed of the rotary classifier.

(c) If the motor current indicated by the motor current signal A is less than the lower limit delimited by the proper range signal $A_2$, then a command signal $\Delta N>0$ is output to raise the rotational speed of the rotary classifier.

For instance, as indicated by a point a in FIG. 2, if a motor current of the coal pulverizer indicated by the motor current signal A is within a proper range delimited by the proper range signals $A_1$ (upper limit) and $A_2$ (lower limit), then a command signal $\Delta N=0$ is output to maintain the same rotational speed of the rotary classifier. If, during the operation of the coal pulverizer, the coal being fed changes from coal having a high grindability to coal having a low grindability, the load on the pulverizer increases. Hence, the motor current would increase, and the operating point indicating motor current in FIG. 2 would shift from the point a to a point b. However, when the operating point passes a point c on a straight line representing the proper range signal A, (upper limit), a command signal $\Delta N<0$ is output to lower the rotational speed of the rotary classifier.

A rotational speed controller 3 receives the command signal $\Delta N$ issued from the computer unit 2 and controls the rotational speed of the rotary classifier according to the input command signal.

Figure 3:
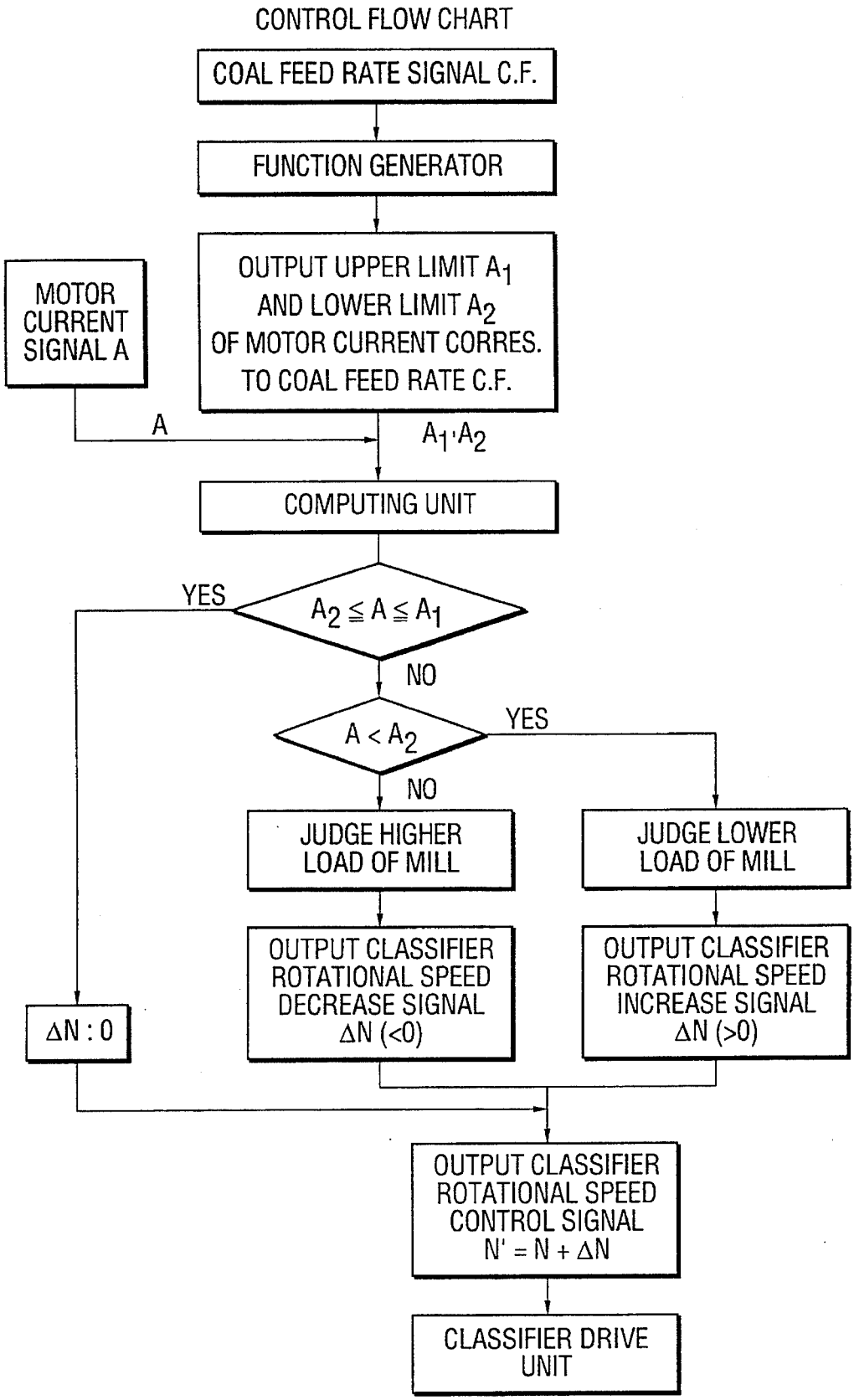
FIG. 3 is a control flow chart of the operation performed by the same preferred embodiment.

The above-described mode of control is represented by the flow chart of FIG. 3.

Figure 7:
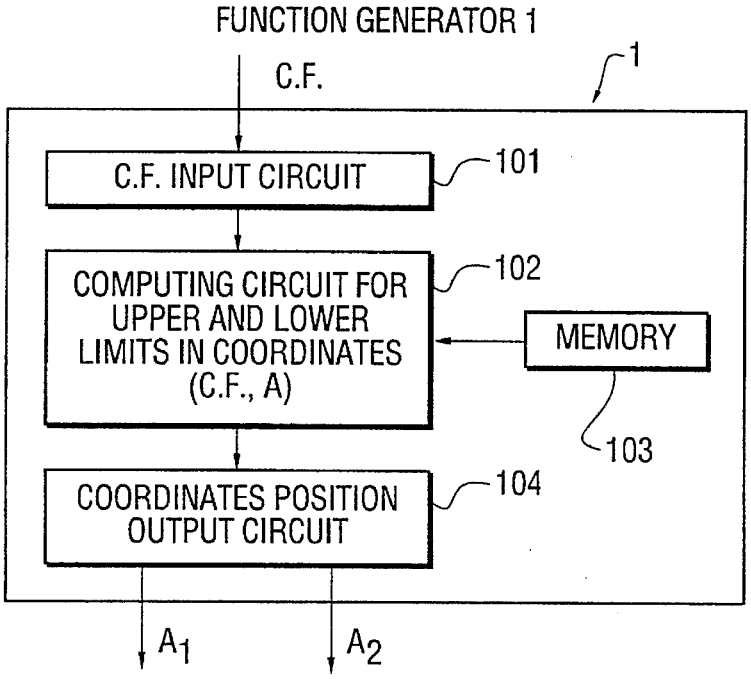
FIG. 7 is a schematic diagram of the function generator of the preferred embodiment of the present invention.
Figure 8:
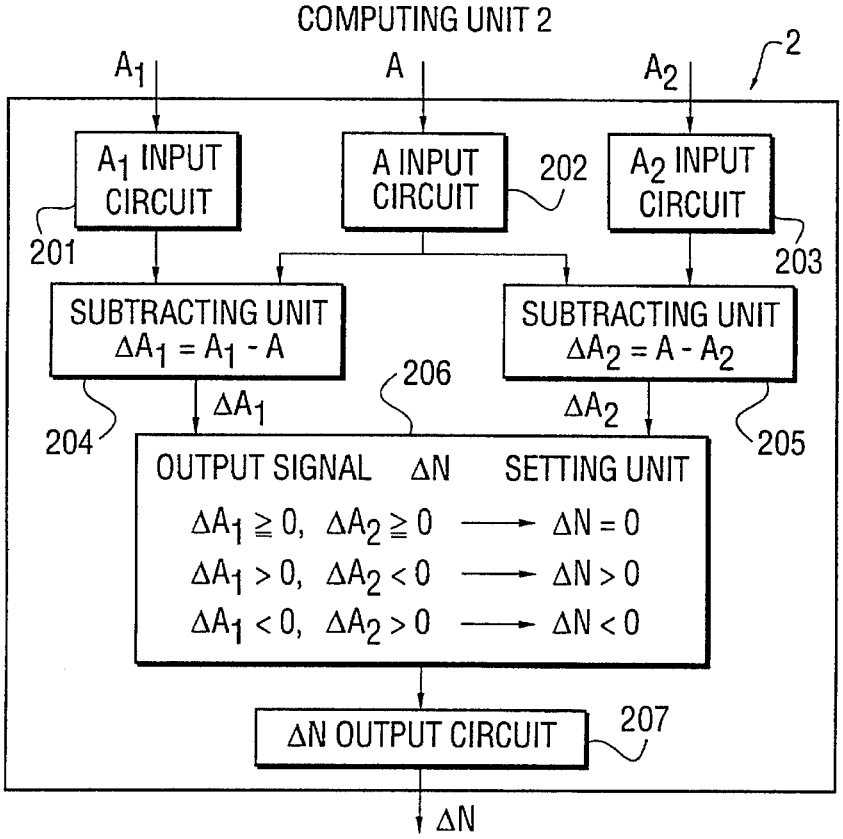
FIG. 8 is a schematic diagram of the computing unit of the same.
Figure 9:
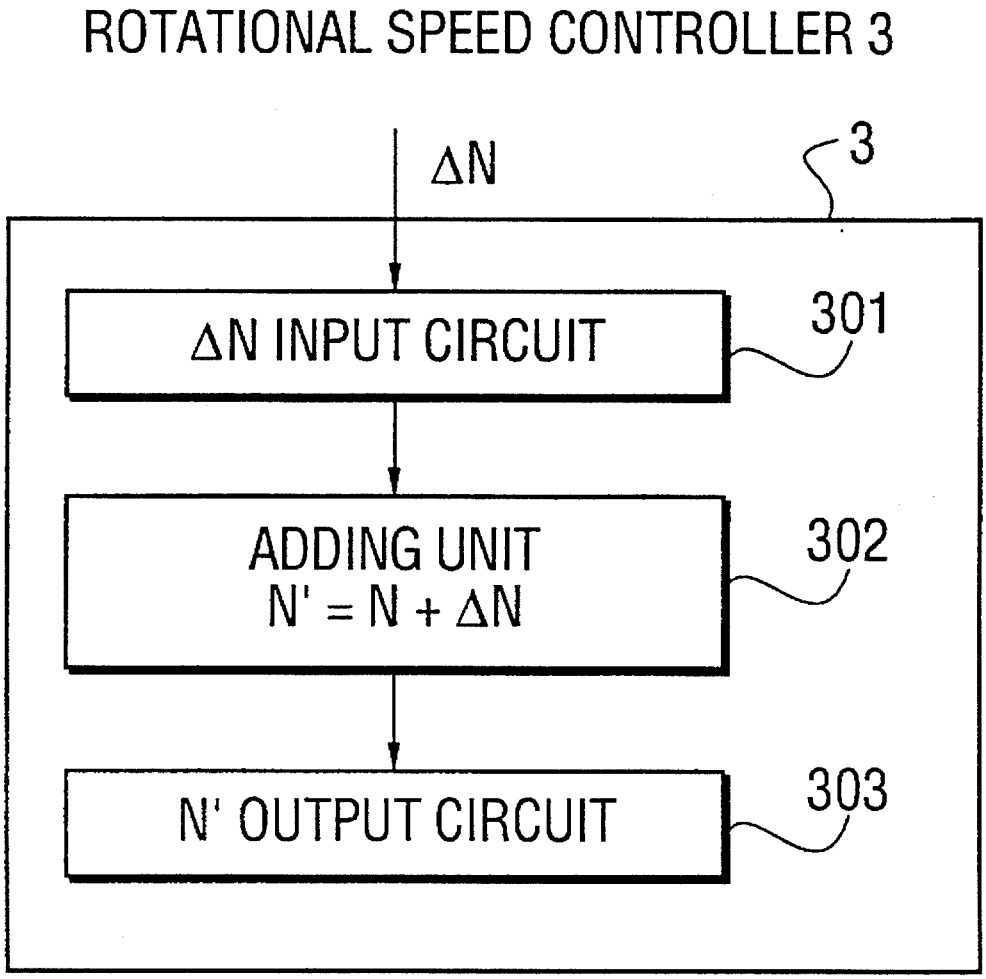
FIG. 9 is a schematic diagram of the rotational speed controller of the same.

The make-up of the function generator 1, computer unit 2, and rotational speed controller 3 are shown in more detail in FIGS. 7, 8 and 9, respectively.

Referring first to FIG. 7, the function generator 1 comprises a C.F. input circuit 101 which receives the coal feed rate signal C.F. from an appropriate detector, known per se, monitoring the feeding of coal to the classifier, a computing circuit 102, a memory 103 which stores data used by the computing circuit to calculate the values $A_1$, $A_2$ as a function of the coal feed rate, and a coordinates position output circuit 104 which converts the calculations made by the computing circuit 102 into signals $A_1$, $A_2$ representative of the coordinates of these points as shown in FIG. 2.

Referring next to FIG. 8, the computing unit 2 comprises respective input circuits 201–203 for receiving signal A from the motor of the pulverizer and the signals $A_1$ and $A_2$ output by the function generator 1, subtractor 204 for subtracting the value of the motor current signal A from the value of the upper limit signal $A_1$ at the current coal feed rate, subtractor 205 for subtracting the value of the lower limit signal $A_2$ at the current coal feed rate from the value of the motor current signal A, a comparitor which compares the values $\Delta A_1$ and $\Delta A_2$ generated in the subtractors 204, 205 with zero value and sets the command signal $\Delta N$ on the basis of such comparisons, and a command signal output circuit 207 which outputs the command signal $\Delta N$ to the rotational speed controllers.

As shown in FIG. 9, the rotational speed controller 3 includes an input circuit 301 which receives the command signal $\Delta N$, an adder 302 which sums the value of the command signal and the value of the current signal controlling the drive unit of the rotary classifier, and an output circuit 303 which outputs the sum as a drive signal to the drive unit, such as a stepper motor, of the rotary classifier.

As could be appreciated by anyone of ordinary skill in the art, although FIGS. 7, 8 and 9 seem to show the function generator 1, computer unit 2 and rotational speed controller 3 as made up of dedicated hardware, the disclosed functions of generating signals $A_1$, $A_2$, computing the command signal $\Delta N$, and incrementing the signal to the drive unit with the command signal $\Delta N$ could all be performed by a microprocessor programmed according to the flowchart shown in FIG. 3.

Figure 4B:
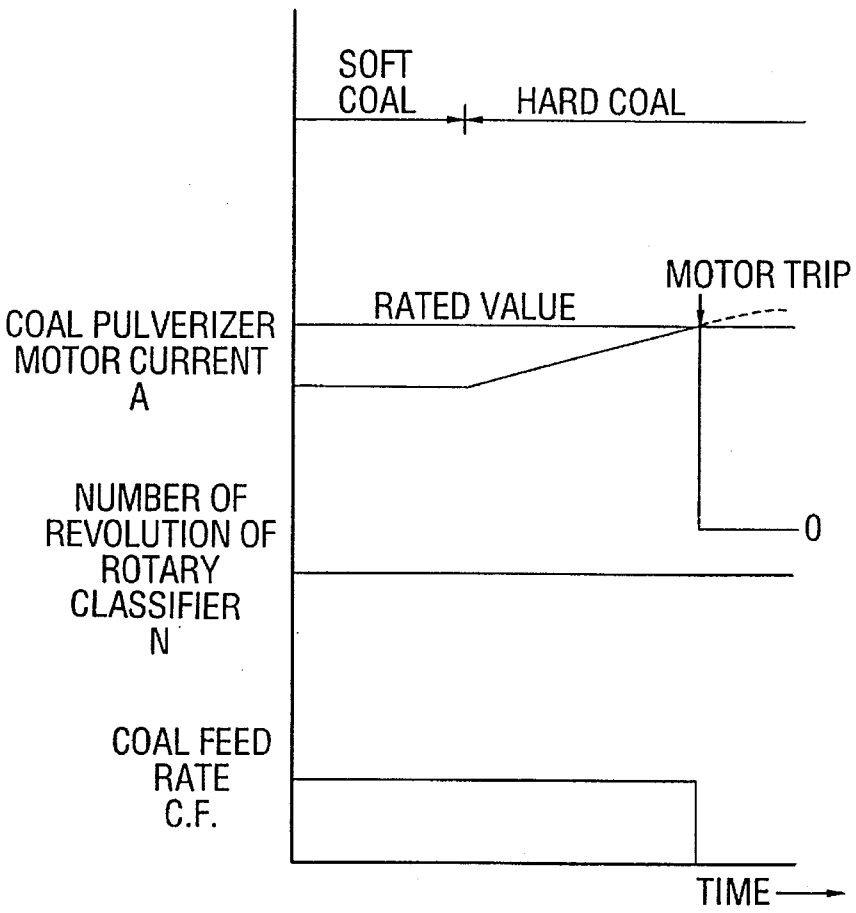
FIGS. 4(*a*) and 4(*b*) are diagrams illustrating the operations of the same preferred embodiment and a conventional classifier, respectively, when the type of coal being fed is changed during operation.
Figure 4A:
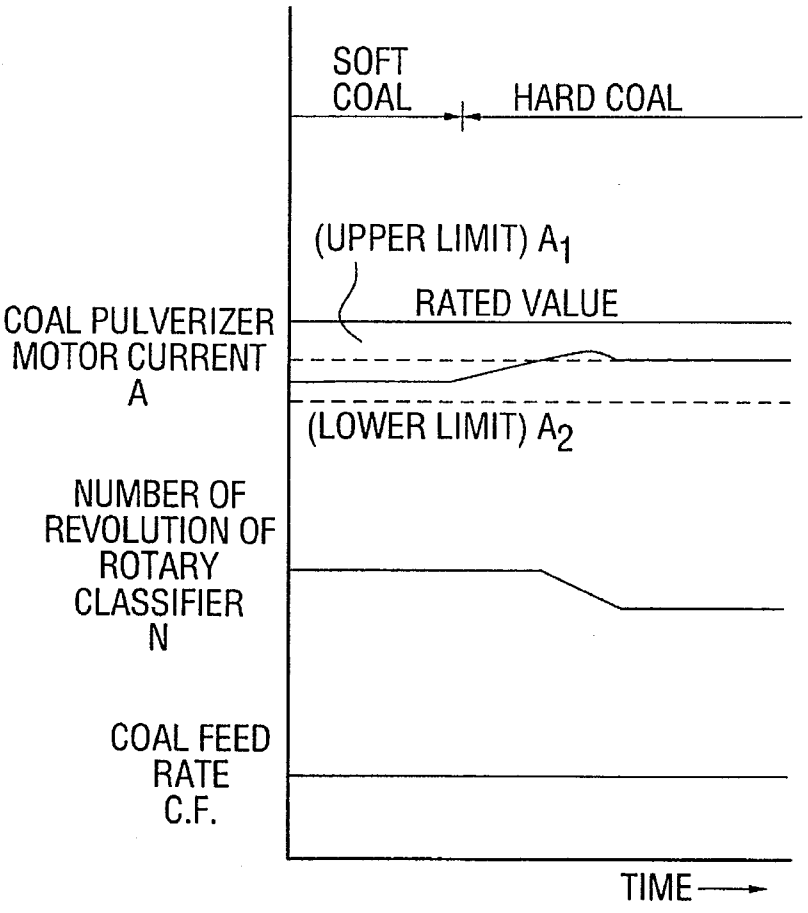
Figure 5:
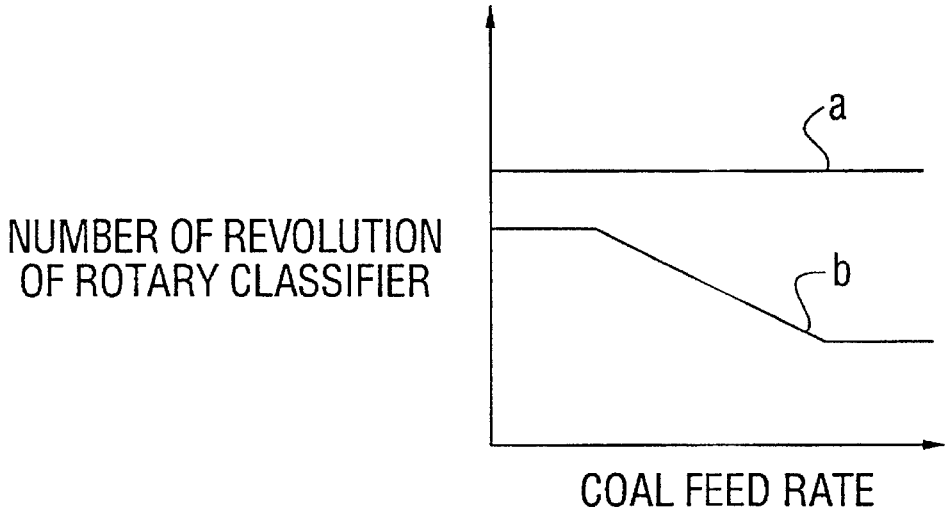
FIG. 5 is a diagram illustrating a method of operation of one example of a coal pulverizer associated with a rotary classifier in the prior art.
Figure 6:
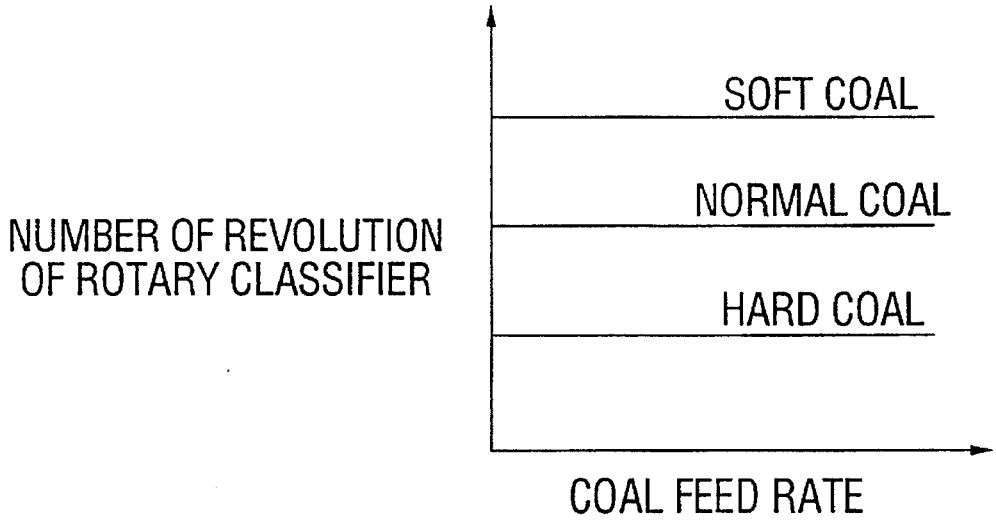
FIG. 6 is a diagram illustrating another method of operation of a similar coal pulverizer in the prior art.

The effects and advantages of the above-described embodiment of the present invention are evident from FIGS. 4(*a*) and 4(*b*) showing a comparison of the operations of the present invention and a coal pulverizer associated with a rotary classifier in the prior art. The operations of the coal pulverizer of the present invention is shown in FIG. 4(*a*) while the operation of the coal pulverizer in the prior art is shown in FIG. 4(*b*).

As can be seen in these figures, when a coal feed rate is kept constant during operation of the present invention, even if the coal being fed should change from soft coal to hard coal, the rotational speed of the rotary classifier is lowered. Hence, a load on the pulverizer is not increased much. Thus, the motor current of the coal pulverizer can be maintained within the proper range. Therefore, the coal pulverizer can operate safely. ON the other hand, in the coal pulverizer associated with a rotary classifier in the prior art, since the rotational speed of the rotary classifier is constant, if the coal being fed should change from soft coal to hard coal, a load on the coal pulverizer is increased. Hence, the motor current of the coal pulverizer increases and eventually reaches a rated value, i.e. the upper limit. Therefore, the motor will trip.

As described in detail above, according to the present invention, a rotary speed of a rotary classifier is controlled in such a manner that a motor current of the coal pulverizer can be maintained within a proper range by the function generator, computing unit and rotational speed controller. Consequently, even if a coal feed rate and/or the type of coal should change, the coal pulverizer always operates safely without tripping the motor.

While a principle of the present invention has been described above in connection with one preferred embodiment in the invention, it is intended that all matter contained in the above description and illustrated in the accompanying drawings be interpreted as illustrative of the invention and not in a limiting sense.

What is claimed is:

1. A method for operating a coal pulverizer associated with a rotary classifier having a rotary speed, said method comprising: detecting a range at which coal is fed to the pulverizer and generating a respective allowable range of a current flowing to a motor of the coal pulverizer as a function of each detected rate at which coal is fed to the pulverizer, and controlling the rotary speed of the rotary classifier so that the current flowing to the motor of the coal pulverizer falls within the respective allowable generated preset range for the detected coal feed rate.

2. A control system of a coal pulverizer associated with a rotary classifier having a rotary speed, said system comprising: function generator means for receiving a signal indicative of a current rate at which coal is being fed to the classifier and for outputting signals representing a preset range of current flowing to the motor of the coal pulverizer for said feed rate; computing means responsive to a current signal indicative of the current flowing to the motor of the coal pulverizer and the signals output from said function generator means for outputting a command signal which will maintain the rotary speed of the rotary classifier when said motor current signal is within said preset range, and for outputting a command signal which will decrease or increase the rotary speed of said rotary classifier when said motor current has increased or decreased, respectively, beyond said preset range; and rotational speed controller means responsive to the command signal of said computing means for regulating the rotary speed of said rotary classifier on the basis of the command signal produced by said computing means.

* * * * *